US008674916B2

(12) United States Patent
Liu et al.

(10) Patent No.: US 8,674,916 B2
(45) **Date of Patent: *Mar. 18, 2014**

(54) DRIVING METHOD FOR REDUCING IMAGE STICKING

(75) Inventors: Pin-Miao Liu, Hsin-Chu (TW); Shui-Chih Lien, Hsin-Chu (TW); Chia-Horng Huang, Hsin-Chu (TW); Chien-Huang Liao, Hsin-Chu (TW); Yu-Hsi Ho, Hsin-Chu (TW); Ting-Jui Chang, Hsin-Chu (TW); Yao-Jen Hsieh, Hsin-Chu (TW); Jenn-Jia Su, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 242 days.

This patent is subject to a terminal disclaimer.

(21) Appl. No.: 13/197,779

(22) Filed: Aug. 4, 2011

(65) Prior Publication Data

US 2012/0200551 A1 Aug. 9, 2012

Related U.S. Application Data

(63) Continuation-in-part of application No. 11/747,920, filed on May 14, 2007, now Pat. No. 8,013,823.

(30) Foreign Application Priority Data

Nov. 15, 2006 (TW) ..... 95142265 A

(51) Int. Cl.
*G09G 3/36* (2006.01)

(52) U.S. Cl.
USPC ..... 345/87; 345/88; 345/90; 345/204; 345/690

(58) Field of Classification Search
USPC ..... 345/87–104, 204, 205, 690
See application file for complete search history.

(56) References Cited

U.S. PATENT DOCUMENTS

| | | | | |
|---|---|---|---|---|
| 4,789,223 | A | 12/1988 | Kasahara | |
| 5,147,903 | A | 9/1992 | Podszun | |
| 5,583,532 | A | 12/1996 | Watanabe | |
| 5,986,724 | A | 11/1999 | Akiyama | |
| 6,803,976 | B1 | 10/2004 | Fujioka | |
| 6,822,630 | B2 | 11/2004 | Moriwaki | |
| 6,839,122 | B2 | 1/2005 | Chung | |
| 6,940,500 | B2 | 9/2005 | Washio et al. | |
| 7,768,489 | B2 | 8/2010 | Liu | |
| 8,013,823 | B2 * | 9/2011 | Liu et al. | 345/90 |
| 8,035,598 | B2 | 10/2011 | Liao | |
| 2002/0149549 | A1 * | 10/2002 | Ohta et al. | 345/87 |
| 2004/0189586 | A1 * | 9/2004 | Nagase | 345/100 |

(Continued)

FOREIGN PATENT DOCUMENTS

| | | |
|---|---|---|
| CN | 1420482 A | 5/2003 |
| CN | 1648730 A | 8/2005 |
| TW | 503334 | 9/2002 |
| TW | 1230371 | 4/2005 |

*Primary Examiner* — Joe H Cheng
*Assistant Examiner* — Lisa Landis
(74) *Attorney, Agent, or Firm* — Winston Hsu; Scott Margo

(57) ABSTRACT

A driving method with reducing image sticking effect is disclosed. The driving method includes applying a voltage on the data lines for trapping impurities crossing the data lines and lowering the degree of the image sticking effect, and applying different asymmetric waveforms to different data lines for trapping impurities crossing the data lines and lowering the degree of the image sticking effect.

14 Claims, 17 Drawing Sheets

(56) References Cited

U.S. PATENT DOCUMENTS

2006/0007080 A1 1/2006 Yeh
2006/0256245 A1 11/2006 Verschueren
2011/0080396 A1 4/2011 Liu
2011/0115780 A1 5/2011 Liu

* cited by examiner

DRIVING METHOD FOR REDUCING IMAGE STICKING

CROSS REFERENCE TO RELATED APPLICATIONS

This is a continuation-in-part application of application Ser. No. 11/747,920, filed May 14, 2007.

BACKGROUND OF THE INVENTION

1. Field of the Invention

The present invention relates to a driving method for reducing image sticking effect of display images, and more specifically, to a driving method for reducing image sticking effect of images on a liquid crystal display (LCD).

2. Description of the Prior Art

FIG. 1 is a diagram illustrating a cross-sectional view of a conventional liquid crystal display (LCD) 100. As shown in FIG. 1, the LCD 100 comprises two glass substrates, G1 and G2, and a liquid crystal (LC) layer L1 disposed between the glass substrates G1 and G2. A plurality of data lines (not shown) and a plurality of scan lines (not shown) are laid on the glass substrate G1 and are interwoven each other to form a plurality of the pixel areas. The liquid crystal layer L1 comprises liquid crystal molecules X, of which the rotation can be controlled by applying voltage. In ideal condition, the LC layer L1 only contains liquid crystal molecules X only. However, some other particles, namely impurities P, also exist in the liquid crystal layer L1. The impurities P, as shown in FIG. 1, can be ions with positive or negative charges, or neutral molecules with certain polarities.

FIG. 2 is a diagram illustrating the general driving method of the conventional LCD 100 to display an image. As mentioned above, the pixel areas are formed by interweaving data lined and scan lines and therefore, the pixel areas are indexed as $P_{mn}$ where m and n indicate the number of the data line and scan line which are responsible for driving the pixel $P_{mn}$. The data voltages carried by the data lines correspond to the displayed image. However, only when the scan line $S_n$ turns on, the data voltages on the data line $D_m$ is input into the pixel area $P_{mn}$. For example, the data voltage on the fourth data line $D_4$ will be input into pixel area $P_{43}$ when the third scan line $S_3$ turns on, and so forth. Therefore, the LC molecules in the pixel $P_{43}$ will rotate according to the data voltages on the fourth data line $D_4$ when the third scan line $S_3$ turns on. Furthermore, when the scan line turns off, the data voltages on the data lines are not input into the pixels, and the liquid crystal molecules X in this pixel remain the state caused by the previous data voltages on the data lines. There are always data voltages on the data lines but the scan lines will sequentially turn on from $G_1$ to $G_n$. As a result, an image is fully displayed on the screen while all data voltages on data lines are input into the pixels. The duration which this sequential process takes to display an image is called a "frame time". Subsequently, the next frame starts while turning on the first scan line $S_1$ to the last scan line $S_n$ to show the next image, and so forth. In general, between two frames, there is a moment when all of the scan line turns off, which is so-called "blanking time".

FIG. 3 is a diagram illustrating the relation between the rotation of the liquid crystal molecules X and the data voltages $V_d$ on the data lines in more detail. In reality, one end of the pixel areas is connected to the data line where a data voltage $V_d$ is applied, and the other end of the pixel is connected to the other glass substrate G2 where a fixed common voltage $V_{com}$ is applied. Therefore, the actual voltage sensed by the liquid crystal molecules X in the pixel is the relative voltage difference between the data voltage $V_d$ and the common voltage $V_{com}$. This relative voltage difference is the real factor that determines the rotation of the liquid crystal molecules X.

FIG. 4 is a diagram illustrating the distribution of the impurities P after the conventional LCD 100 displays an image for a period of time. If the data voltages $V_d$ on the data lines were perfectly symmetric AC (alternative current) waveform relative to the common voltage $V_{com}$, the net movement of the impurities P would be zero and their distribution would remain as the initial condition. Nevertheless, the data voltages are slightly asymmetric AC waveforms unavoidably so that a net DC voltage is formed after displaying an image for a period of time. This DC voltage induces the positive-polarized impurities P moving and gradually accumulating at one side of the LC layer L1 while the negative-polarized impurities P accumulate at the other side of the LC layer L1. These accumulated impurities P generate an inner electric field E in the liquid crystal layer L1, which shields off the following data voltage to apply on the liquid crystal molecules X. Consequently, the liquid crystal molecules X cannot rotate to the correct direction and the image sticking problem occurs.

FIG. 5 is a diagram illustrating the distribution of impurities P after the conventional LCD 100 displays images for a period of time. Besides the net DC voltage, the movement of the impurities P are affected by the directions of the liquid crystal molecules X as well. As shown in FIG. 5, the liquid crystal molecules X points at a specific direction which is determined by the voltage difference V between data voltage $V_d$ and common voltage $V_{com}$. Such a direction causes the horizontal movements of the impurities P other than the vertical movements. The impurities P therefore accumulate to form a "boundary" in the LC layer L1 if the movements described above remain for a period of time. The impurities-formed boundaries in the LC layer L1 distort the input voltage so that an abnormal image appears near the boundary which is the so-called line-shape image sticking.

SUMMARY OF THE INVENTION

The present invention discloses a driving method for reducing image sticking associated with images of a liquid crystal display. The liquid crystal display comprises a plurality of data lines, a plurality of scan lines and a plurality of pixel areas. The driving method comprises during a first period of time, sequentially turning on the plurality of scan lines and inputting data of a first image to the plurality of pixel areas; during a second period of time, sequentially turning on the plurality of scan lines and inputting data of a second image to the plurality of pixel areas; and between the first period of time and the second period of time, generating and applying a first voltage according to voltage levels corresponding to the data of the first image.

The present invention further discloses a driving method for reducing image sticking associated with images of a liquid crystal display. The liquid crystal display comprises a plurality of data lines, a plurality of scan lines and a plurality of pixel areas. The driving method comprises during a first period of time, sequentially turning on the plurality of scan lines and inputting data of a first image to the plurality of pixel areas; during a second period of time, sequentially turning on the plurality of scan lines and inputting data of a second image to the plurality of pixel areas; and between the first period of time and the second period of time, generating and applying a first voltage according to voltage levels corresponding to data of the first image on a first set of the plurality of data lines.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
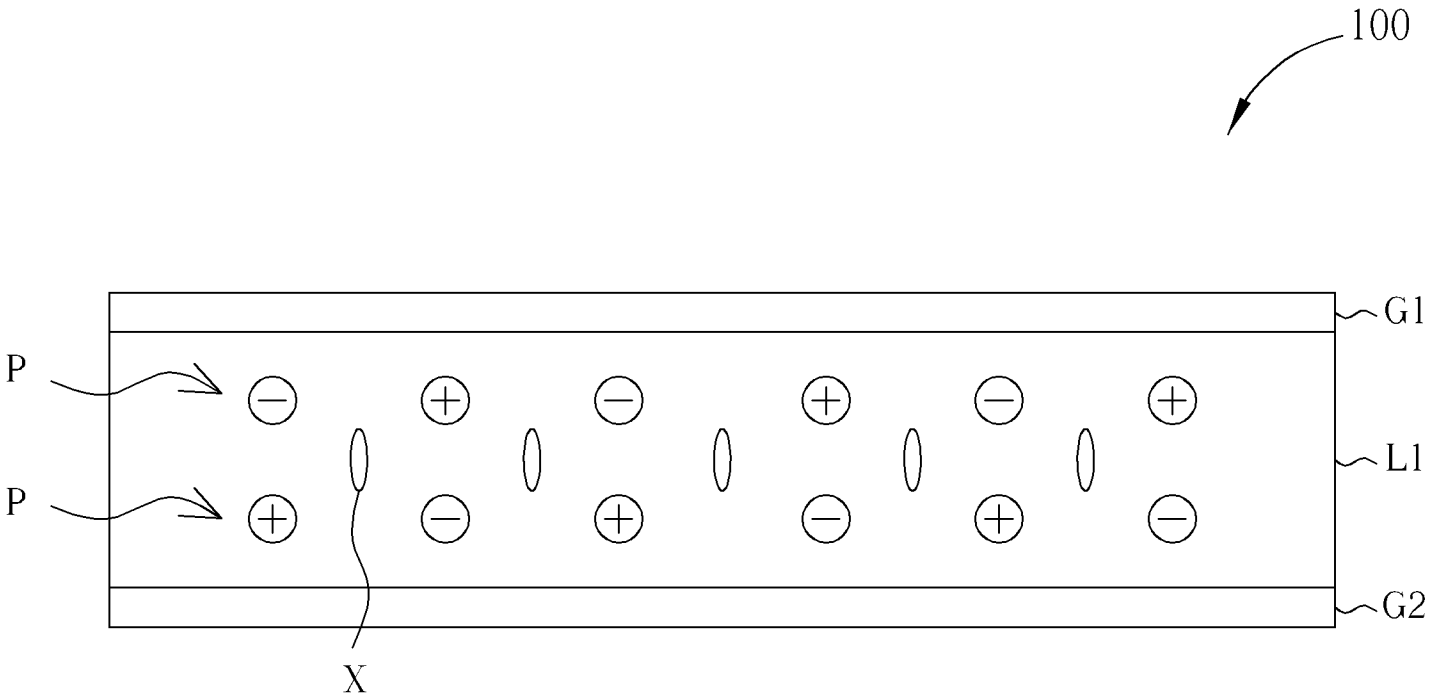
FIG. 1 PRIOR ART
FIG. 1 is a diagram illustrating a cross-sectional view of a conventional LCD.
Figure 2:
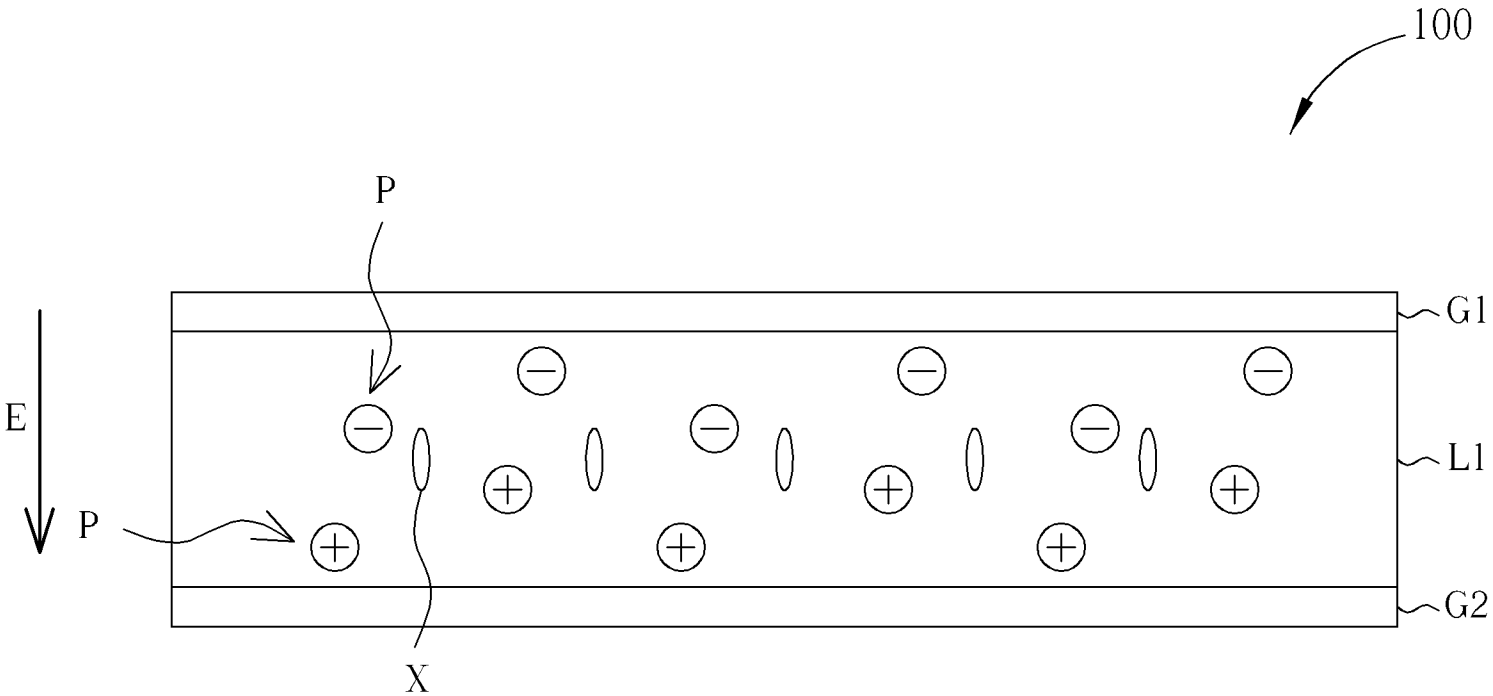
FIG. 2 PRIOR ART
FIG. 2 is a diagram illustrating the general driving method of the conventional LCD.
Figure 3:
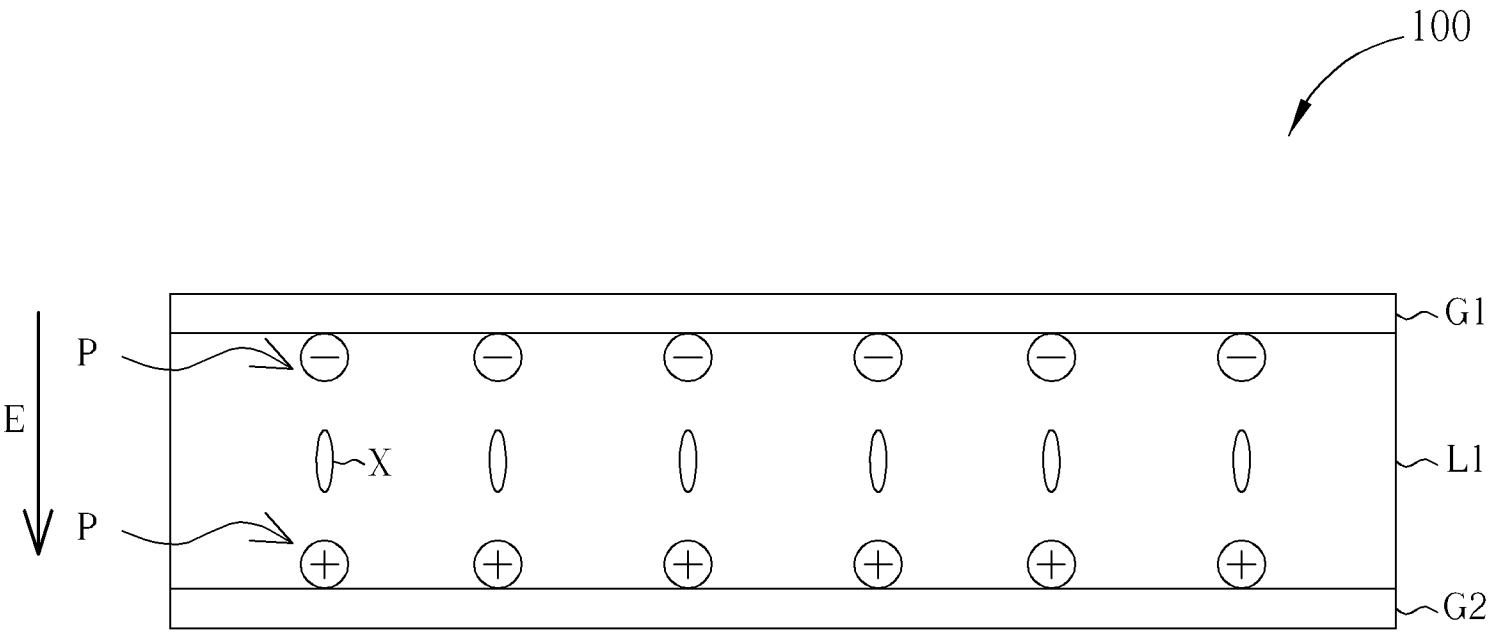
FIG. 3 PRIOR ART
FIG. 3 is a diagram illustrating the data voltage is applied on a pixel.
Figure 4:
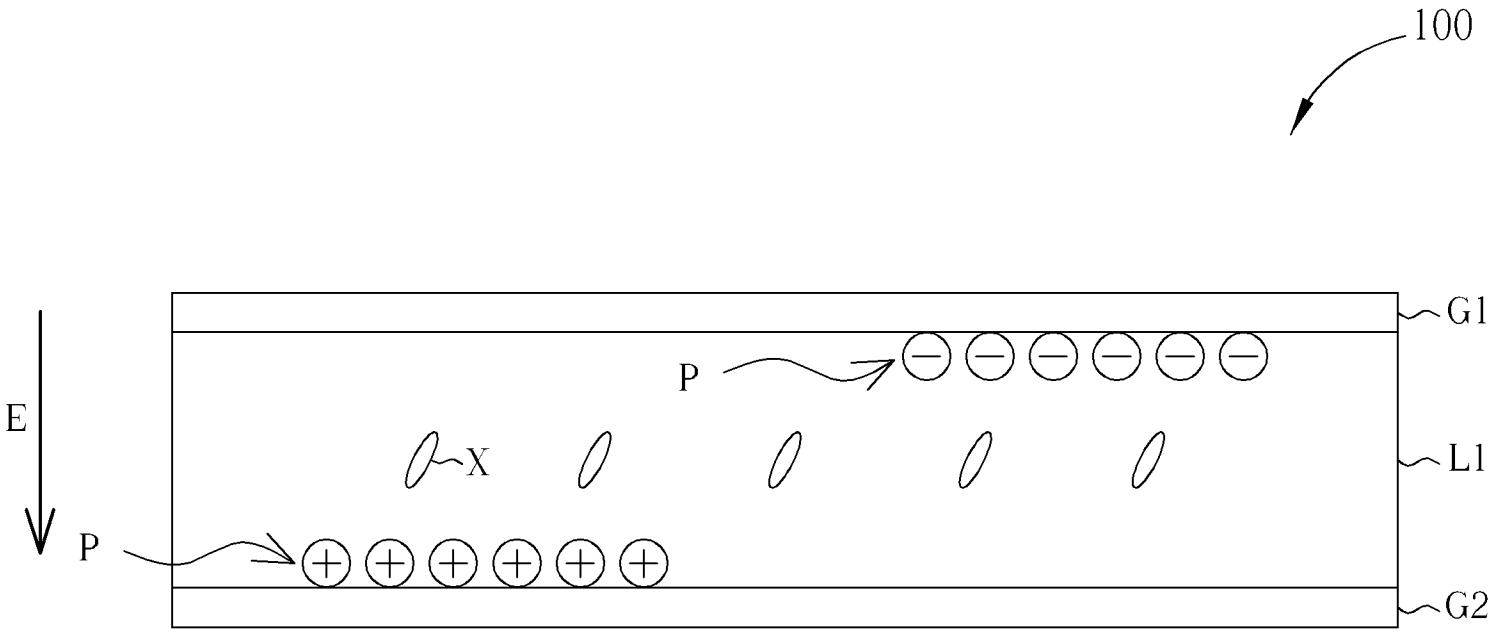
FIG. 4 PRIOR ART
FIG. 4 is a diagram illustrating the distribution of the impurities P after the conventional LCD displays images for a period of time.
Figure 5:
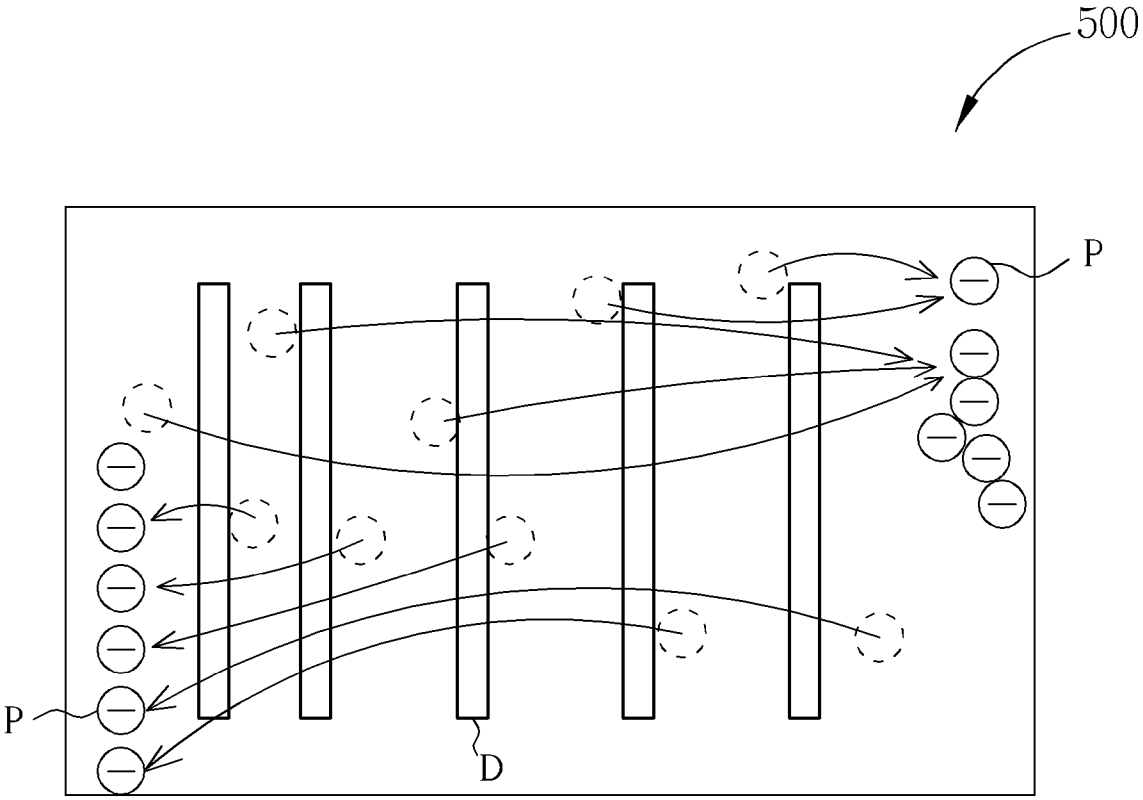
FIG. 5 PRIOR ART
FIG. 5 is a diagram illustrating the distribution of the impurities P affected by the directions of liquid crystal molecules X after the conventional LCD displays images for a period of time.
Figure 6:
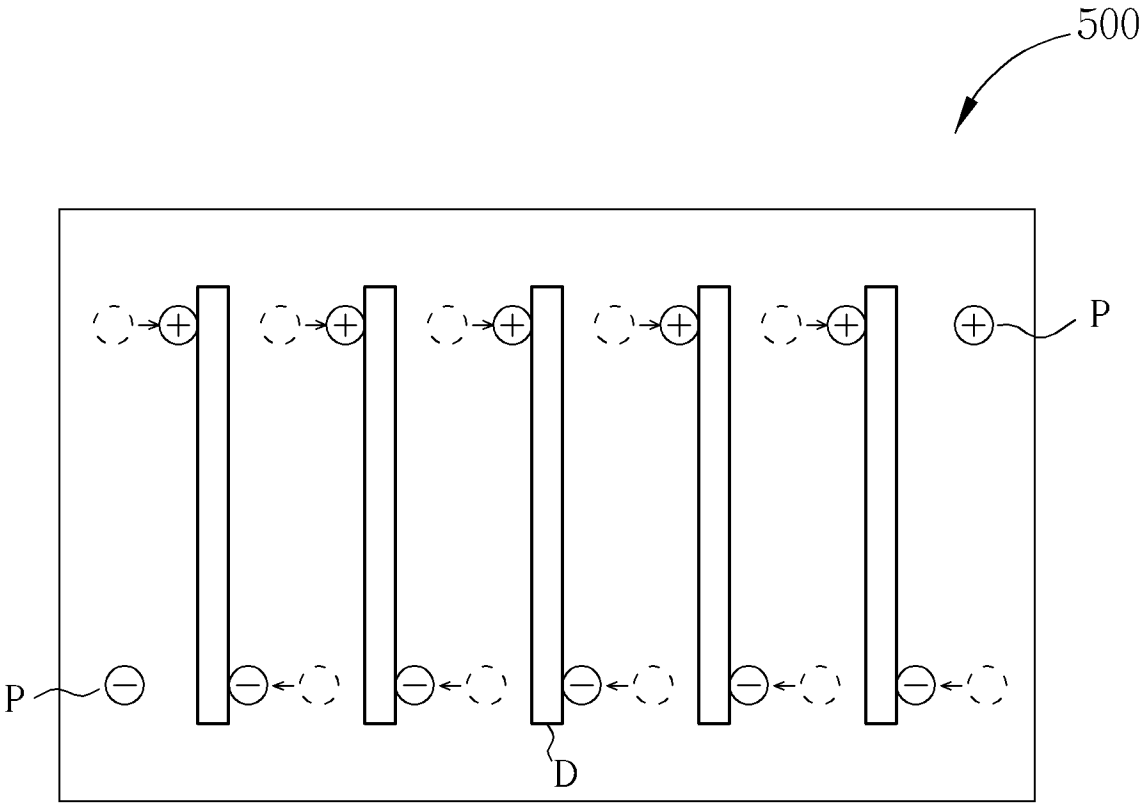
FIG. 6 and FIG. 7 are diagrams illustrating the method for displaying images on an LCD with improved image sticking effect.
Figure 7:
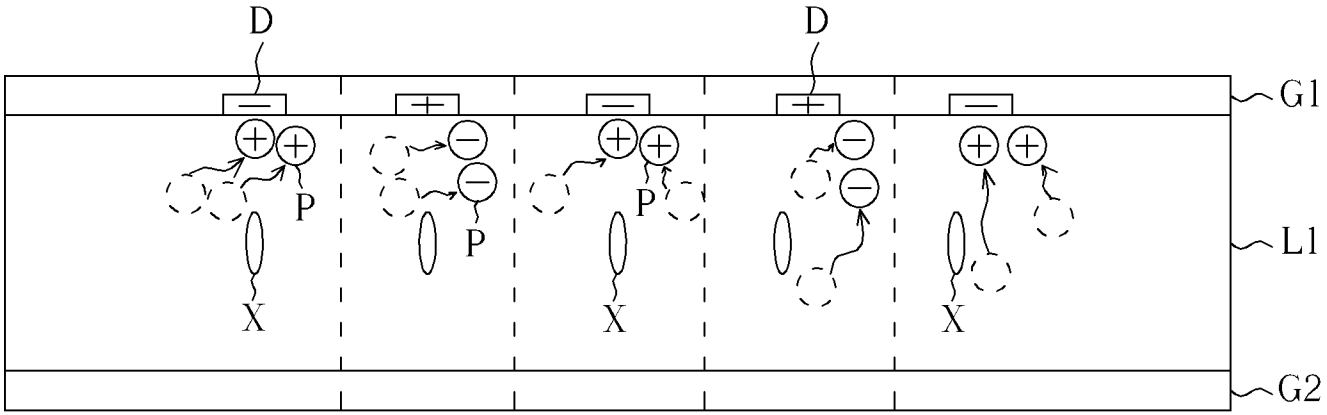

FIGS. 6 and 7 are diagrams illustrating the driving method to improve image sticking for an LCD to display images. As shown in FIG. 6, because a net DC electric field, which is induced by the imperfectly symmetric data voltages $V_d$, and the specific direction of the liquid crystal molecules X, which is determined by the voltage difference between the data voltage $V_d$ and the common voltage $V_{com}$, the impurities P move three-dimensionally to cross several data lines D in the liquid crystal layer L1. Finally the positive-polarized impurities P accumulate in a local region in the LC layer L1, and the negative-polarized impurities P accumulate in another local region in the LC layer L1. Please refer to FIG. 7, the present invention applies high voltages on the data lines D to avoid the impurity particles P pass through the data lines D as shown in FIG. 6. The high voltages applied on the data lines D trap the impurities P to prevent the impurities P from crossing several data lines D. In this way, each data line D will trap some impurities P but the amount of impurities P is inadequate to induce visible image sticking effect. Consequently, the degree of the accumulated impurities P in a local area of the LCD is eased and the image sticking problem is resolved.

According to FIG. 6 and FIG. 7, the method of the present invention of trapping the impurity particles P by the data lines is disclosed. In FIG. 7, positive voltages are applied on some of the data lines D in order to trap the negative-polarized impurities P, and negative voltages are applied on some of the data lines D in order to trap the positive-polarized impurities P. The values of the voltages applied on the data lines D shall be set to effectively trap the impurities P.

Figure 8:
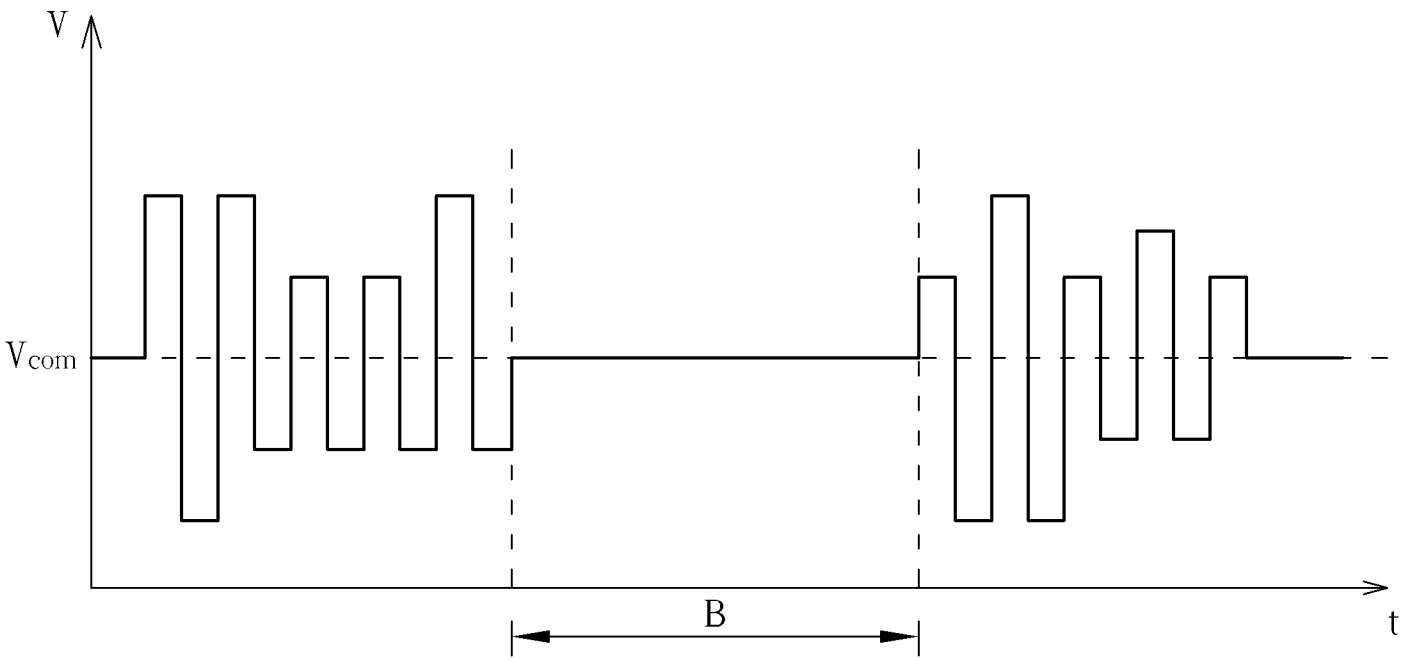
FIG. 8 PRIOR ART
FIG. 8 is a diagram illustrating the LCD displaying images.

FIG. 8 is a diagram illustrating the conventional driving method for an LCD to display images. And the voltage in FIG. 8 represents the data voltage $V_d$ on the data lines D. As mentioned before, as an image is displayed, namely a frame time is completed, there is a moment called "blanking time" before the LCD to display the next image, namely to start the next frame. And all of the plurality of the scan lines turns off during the "blanking time" B. During the frame time, the data lines carry different AC (alternative current) voltage signals that correspond to the data of the displayed images. During the blanking time, the data lines carry a DC (direct current) voltage identical to the common voltage $V_{com}$ which is applied on the glass substrate G2. Therefore, the electrical potential in the liquid crystal layer L1 is identical so that the impurities P are not trapped by the data lines under the conventional driving method for liquid crystal displays.

Nevertheless, since all of the plurality of the scan lines do not transmit any scan signals during the blanking time, any voltage signals carried by the data lines do not input into the pixels and do not affect the rotation of the liquid crystal molecules X either. Utilizing this characteristic of the blanking time B, the present invention applies high voltages on the data lines during the blanking time B to trap the impurities P.

Figure 9:
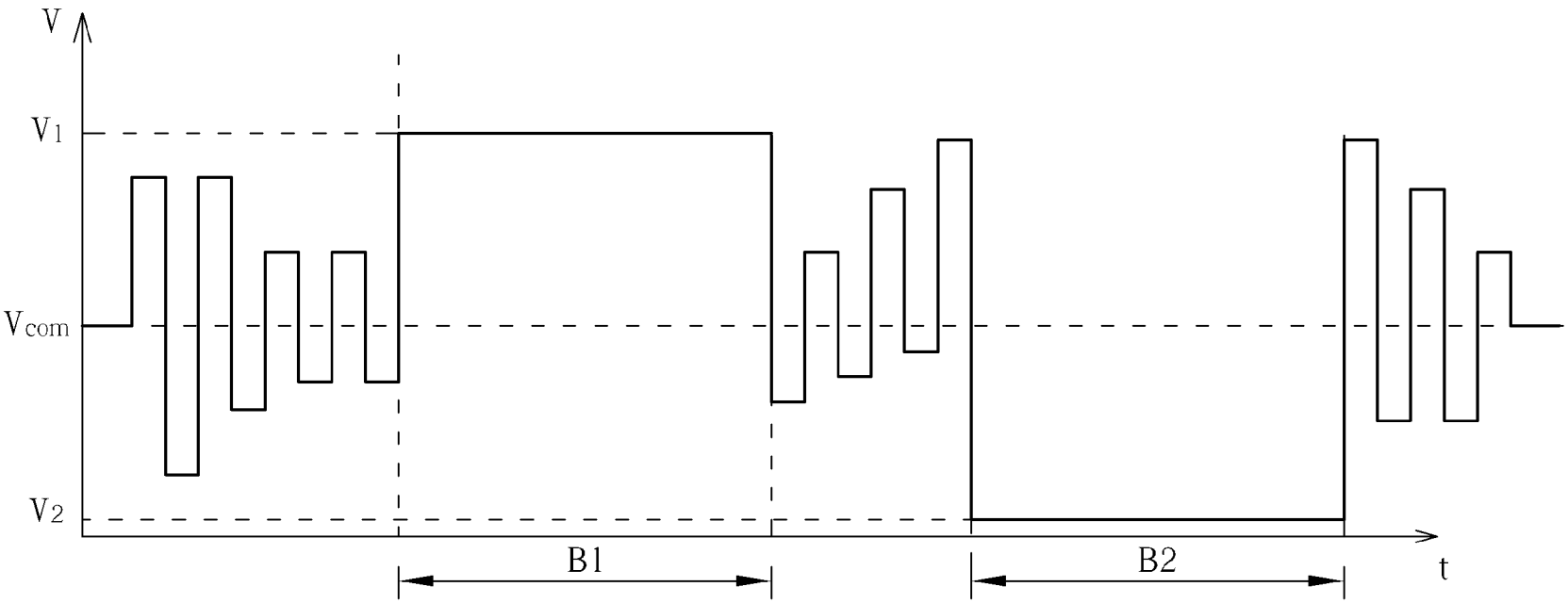
FIG. 9 is a diagram illustrating the method of the present invention applying voltages on the data lines during the blanking area B.

FIG. 9 is a diagram illustrating the driving method to improve image sticking for an LCD, which applies high voltages on the data lines during a first blanking time B1 and a second blanking time B2. As shown in FIG. 9, voltages which are higher than the common voltage Vcom are applied on the data lines D in order to trap the impurities P. However, applying voltages lower than the common voltage Vcom on the data lines D is also feasible to trap the impurities P.

In another embodiment, the voltage applied on the data lines D during the first blanking time B1 requires to be higher than a highest voltage level of data voltages that correspond to the displayed image on the data lines D, or lower than a lowest voltage level of data voltages that correspond to the displayed image on the data lines D.

As illustrated in FIG. 9, the voltage corresponding to the voltage level $V_1$ applied on the data lines during the first blanking time B1 is generated to be higher than a highest voltage level of data voltages that correspond to the displayed image on the data lines D, and the voltage corresponding to the voltage level $V_2$ applied on the data lines during the second blanking time B2 is generated to be lower than a lowest voltage level of data voltages that correspond to the displayed image on the data lines D.

In another embodiment, the voltage level $V_1$ applied on the data lines during the blanking time B is higher than a highest voltage level capable of being inputted to the plurality of pixel areas, and the voltage level $V_2$ applied on the data lines during the blanking time B is lower than a lowest voltage level capable of being inputted to the plurality of pixel areas. For instance, the voltage level $V_1$ is higher than a voltage level corresponding to the maximum gray scale value (e.g. 255), and the voltage level $V_2$ is lower than a voltage level corresponding to the minimum gray scale value (e.g. 0).

Also, a first voltage and a second voltage can be applied to a first set of data lines and a second set of data lines respectively during the blanking time, where the polarity of the second voltage is opposite to the polarity of the first voltage. The first set of data lines may be, for instance, the odd numbered data lines of the plurality of data lines and the second set of data lines, and the second set of data lines may be the even numbered data lines of the plurality of data lines.

Figure 10:
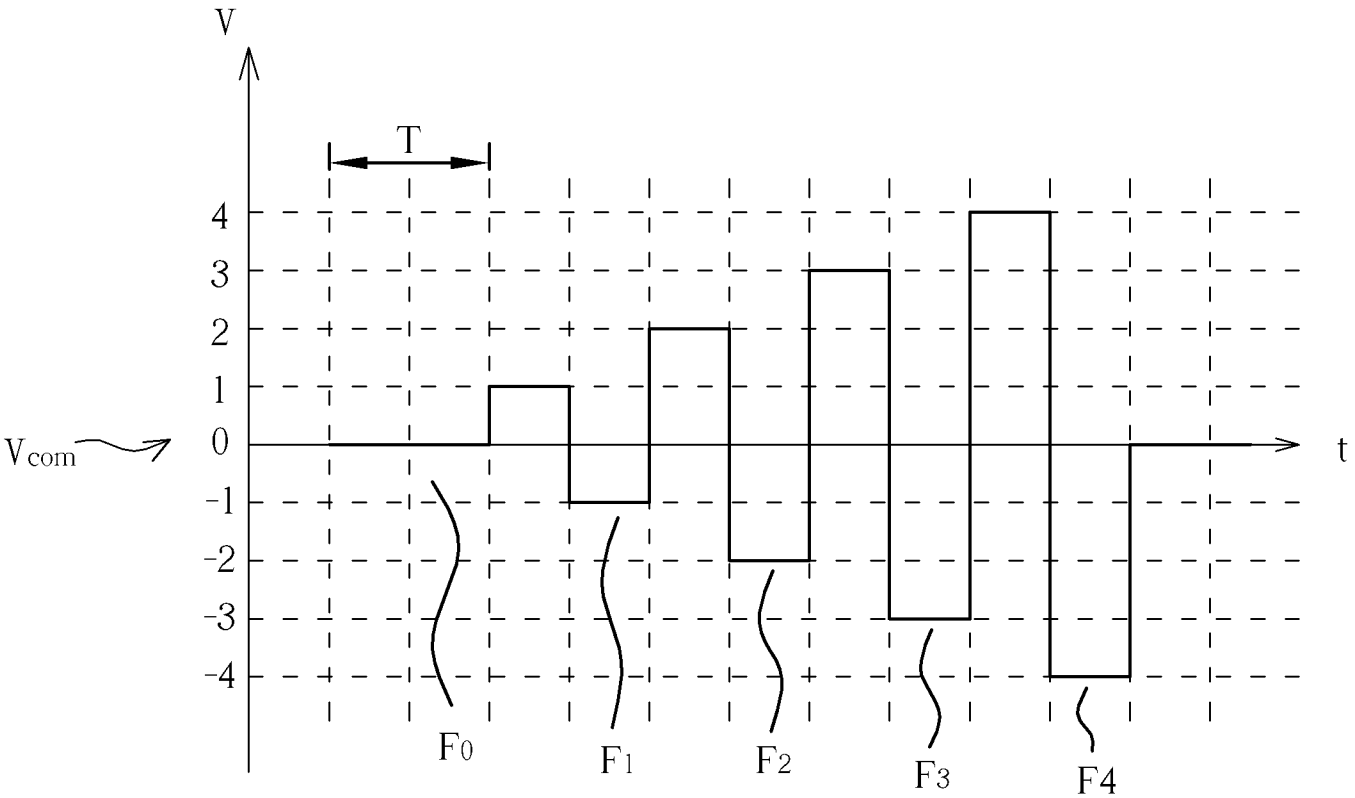
FIG. 10 is a diagram illustrating the voltages carried on the data lines D of the conventional LCD.

FIG. 10 is a diagram illustrating the voltages carried on the data lines D of the conventional LCD. Generally, due to the characteristic of the liquid crystal molecules X, the data voltage signals on data lines D are AC (alternative current) signals, meaning the polarity of the data voltages are continuously alternated to prevent the liquid crystal molecules X from damage. It is assumed that a bit of data need a period T to transmit so that in the first half of the period T, the voltage on the data line D is positive with respect to the common voltage $V_{com}$, and in the second half of the period T, the voltage on the data line D is negative with respect to the common voltage $V_{com}$. The value of the voltages in the first half and the second half of the period T correspond to the content of the bit of the data. As shown in FIG. 10, the common voltage Vcom is assumed to be 0 volts, the content of the data F0 is 0 and the corresponding voltages in the first half and second half of the period T respectively are 0 and 0 volts, the content of the data F1 is 1 and the corresponding voltages in the first half and the second half of the period T respectively are +1 and −1 volts, the content of the data F2 is 2 and the corresponding voltages in the first half and the second half of the period T respectively are +2 and −2 volts, and so on. The voltages corresponding to the data F0, F1, F2 received by the liquid crystal layer L1, in fact, are 0 and 0 volts, +1 and −1 volts, and +2 and −2 volts, because the common voltage Vcom is 0 volts.

Figure 11:
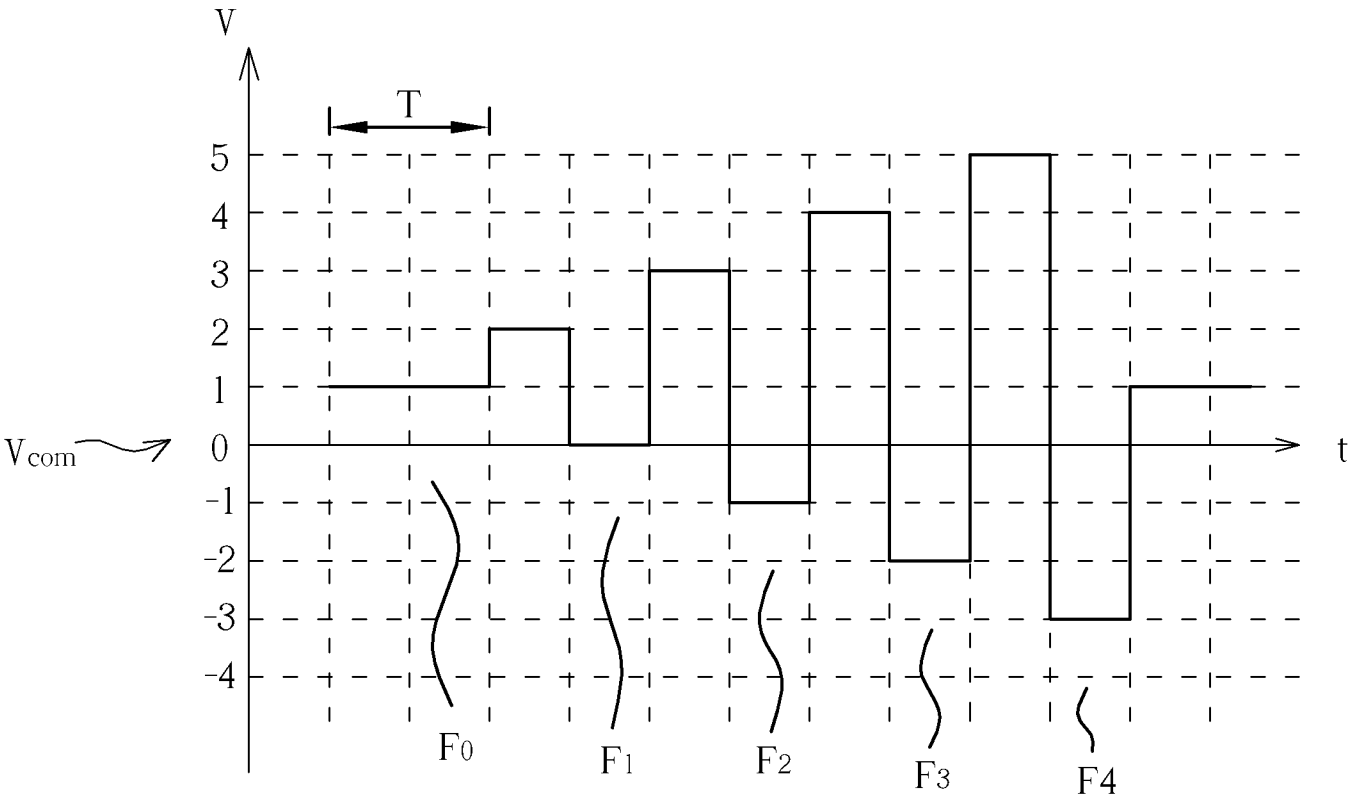
FIG. 11 and FIG. 12 are diagrams illustrating the present invention utilizing different data-to-voltage relations.
Figure 12:
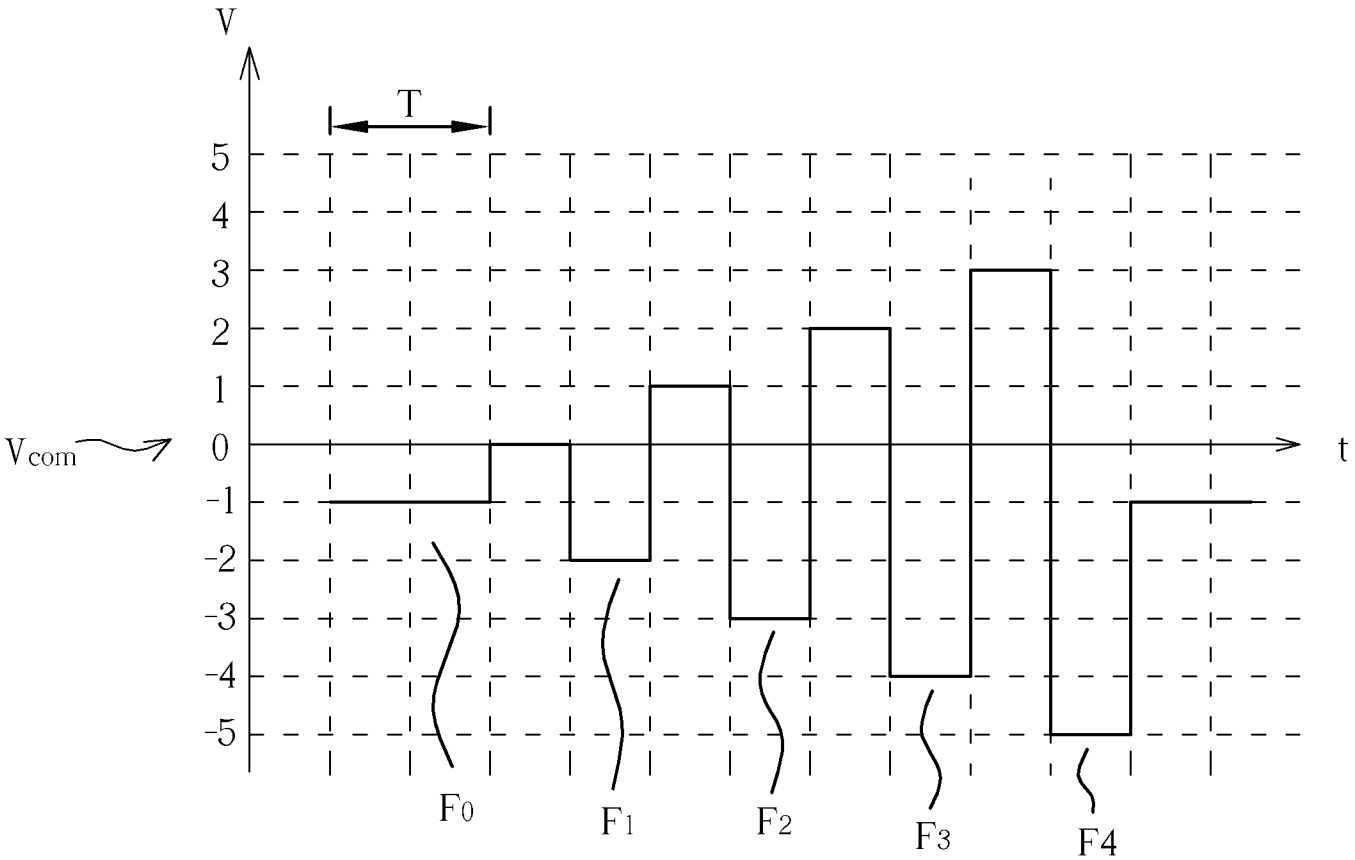

FIG. 11 and FIG. 12 are diagrams illustrating the present invention utilizing different data-to-voltage relations to improve the image sticking. The data-to-voltage relation in FIG. 11 shifts +1 volt compared to the data-to-voltage relation in FIG. 10. As shown in FIG. 11, the content of the data F0 is 0, and the corresponding voltages is 1 volt and 1 volt accordingly. The content of the data F1 is 1, and the corresponding voltages are 2 volt and 0 volts. The content of the data F2 is 2, and the corresponding voltages are 3 volt and −1 volt, and so on. The actual voltages received by the liquid crystal layer L1, since the common voltage $V_{com}$ is 0 volts, are 1 volt and 1 volt (corresponding to the data F0), 2 volt and 0 volts (corresponding to the data F1), 3 volt and −1 volt (corresponding to the data F2), and so on. The data-to-voltage relation in FIG. 12 shifts −1 volt compared to the data-to-voltage relation in FIG. 10. As shown in FIG. 12, the content of the data F0 is 0, and the corresponding voltages is −1 volt and −1 volt. The content of the data F1 is 1, and the corresponding voltages are 0 volts and −2 volt. The content of the data F2 is 2, and the corresponding voltages are 1 volt and −3 volt, and so on. The actual voltages received by the liquid crystal layer L1, since the common voltage $V_{com}$ is 0 volts, are −1 volt and −1 volt (corresponding to the data F0), 0 volts and −2 volt (corresponding to the data F1), 1 volt and −3 volt (corresponding to the data F2), and so on. In the conventional LCD, all the data lines are applied with the same data-to-voltage relation for transmitting voltages to the liquid crystal layer so that on average, there is no voltage difference between data lines. In conventional driving method, therefore, it is easy for the impurities P to pass through the data lines in the liquid crystal layer L1. The present invention of driving method applies different data-to-voltage relations on the data lines as shown in FIG. 11 and FIG. 12 so that on average, there are voltage differences between data lines in the LCD of the present invention. For example, the first data-to-voltage relation is applied to the first data line $D_1$ and the second data-to-voltage relation is applied to the second data line $D_2$. The first data-to-voltage relation is different from the second data-to-voltage relation and the first data line $D_1$ is adjacent to the second data line $D_2$. As a result, on average, a voltage difference rises between the first data line $D_1$ and the second data line $D_2$, and the voltage difference is set to be capable of trapping the impurities P. To, analogize, if there is always certain voltage difference between the data lines of the LCD, the movement of the impurities P is restricted, which lowers the degree of the accumulation of the impurities P in a local region of the LCD and reduces the image sticking accordingly.

Figure 13:
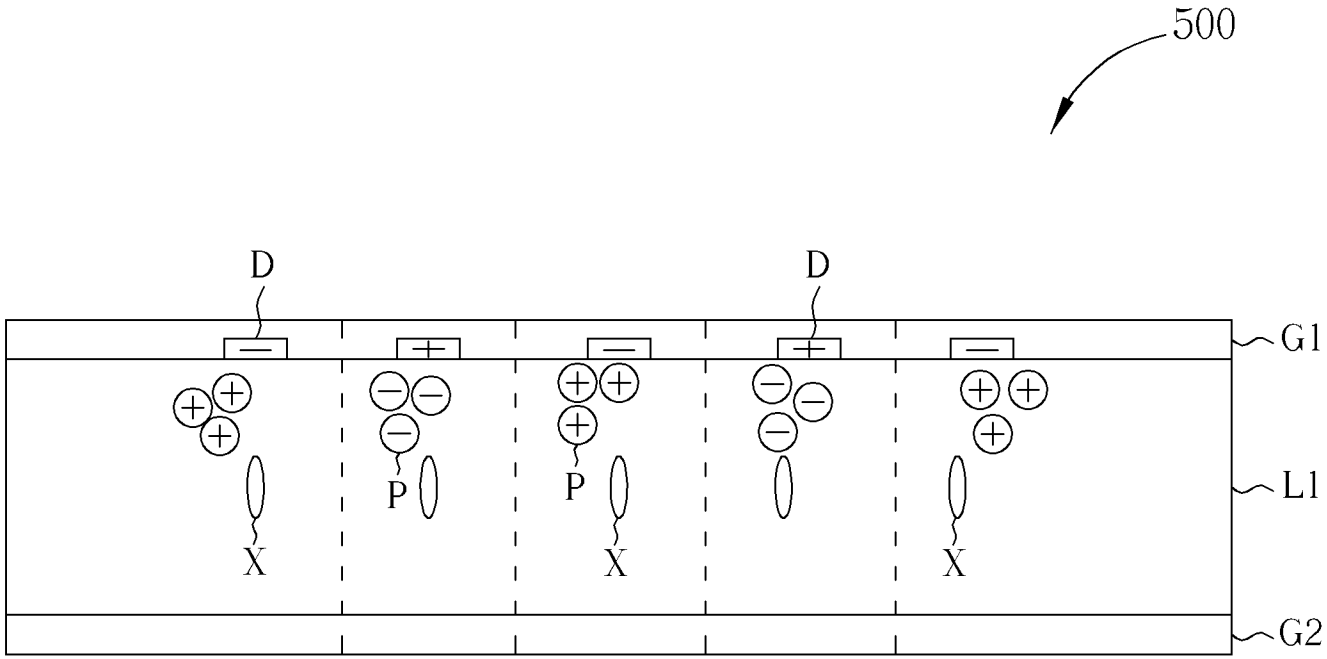
FIG. 13 is a diagram illustrating the voltage difference between the data lines D trapping the impurity particles P.

FIG. 13 is a diagram illustrating the voltage difference between the data lines D trapping the impurity particles P. As shown in FIG. 13, the voltage difference introduced by the different data-to-voltage relations applying on the adjacent data lines effectively traps the impurity particles P, restricts the movement of the impurities P and lowers the degree of the accumulation of the impurities P in a local region of the LCD.

Figure 14:
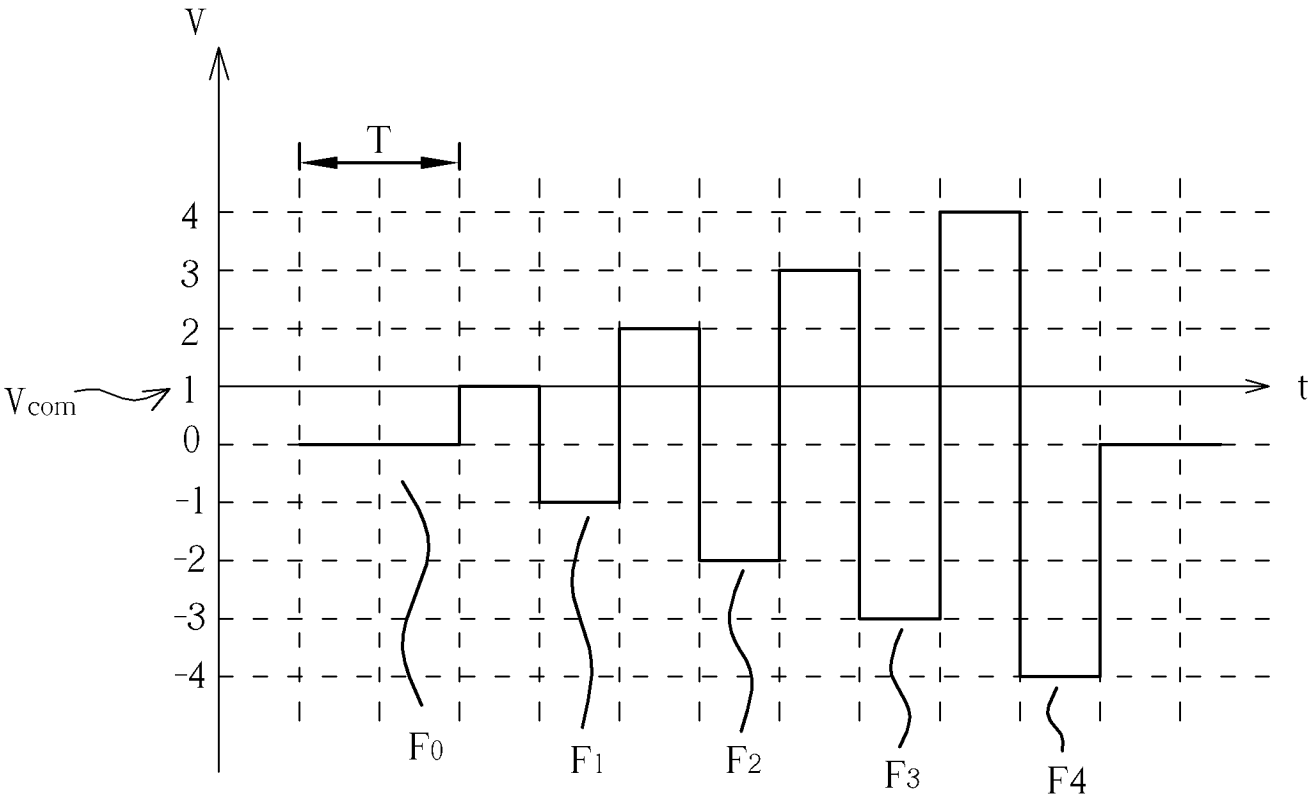
FIG. 14 and FIG. 15 are diagrams illustrating the present invention utilizing different common voltages.
Figure 15:
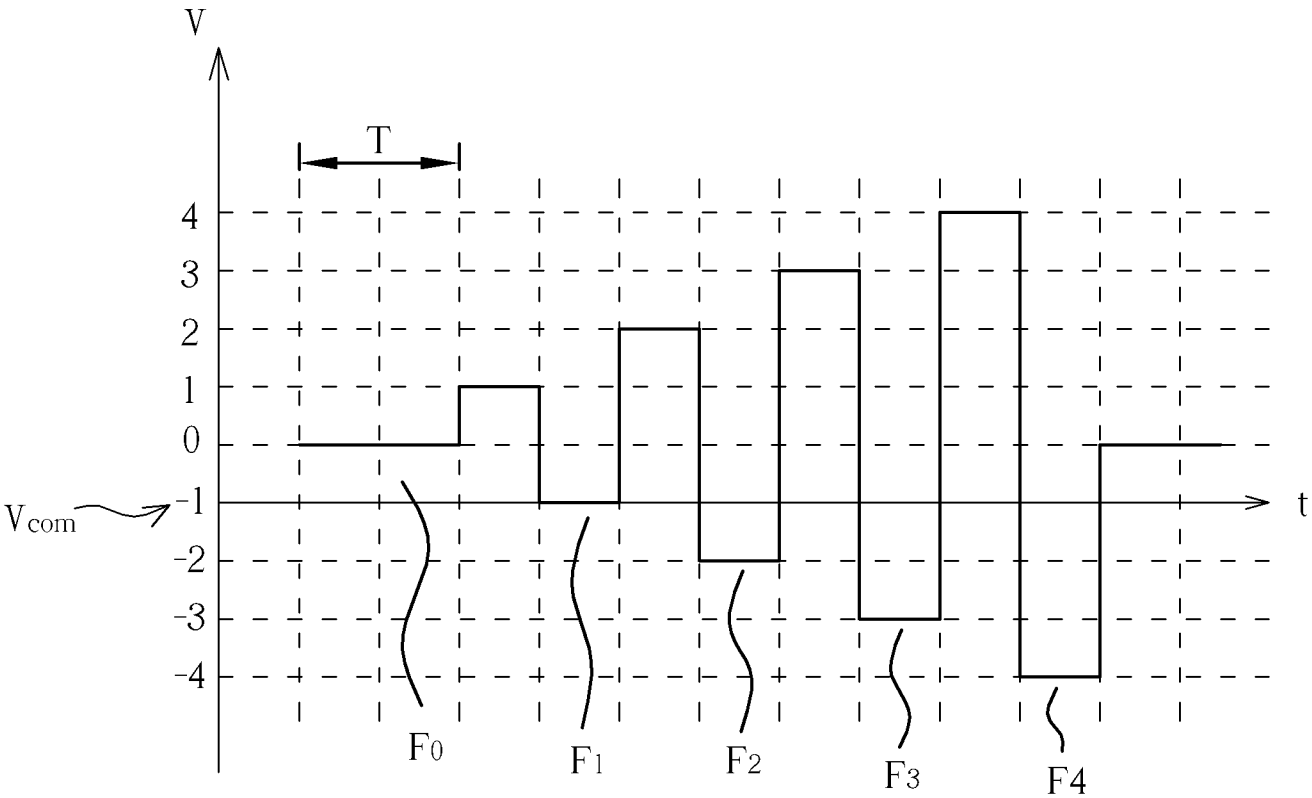

FIG. 14 and FIG. 15 are diagrams illustrating the present invention utilizing different common voltages to improve the image sticking effect. The common voltage $V_{com1}$ in FIG. 14 is shifted by +1 volt compared to the common voltage $V_{com}$ in FIG. 10. As shown in FIG. 14, the content of the data F0 is 0, and the corresponding voltages is 0 volts and 0 volts. The content of the data F1 is 1, and the corresponding voltages are +1 volt and −1 volt. The content of the data F2 is 2, and the corresponding voltages are +2 volt and −2 volt, and so on. However, since the common voltage $V_{com1}$ is +1 volt, the actual voltages received by the liquid crystal layer L1 are −1 volt and −1 volt (corresponding to the data F0), 0 volts and −2 volt (corresponding to the data F1), +1 volt and −3 volt (corresponding to the data F2), and so on. The common voltage $V_{com2}$ in FIG. 15 is shifted by −1 volt compared to the common voltage in FIG. 10. As shown in FIG. 15, the content of the data F0 is 0 and the corresponding voltages is 0 volts and 0 volts. The content of the data F1 is 1 and the corresponding voltages are +1 volt and −1 volt. The content of the data F2 is 2 and the corresponding voltages are +2 volt and −2 volt, and so on. However, since the common voltage $V_{com2}$ is −1 volt, the actual voltages received by the liquid crystal layer L1 are +1 volt and +1 volt (corresponding to the data F0), 2 volt and 0 volts (corresponding to the data F1), +3 volt and −1 volt (corresponding to the data F2), and so on. In the conventional driving method of an LCD, all the data is converted to the voltage on the data lines according to the same data-to-voltage relation, and one end of all the plurality of the pixels is connected to the same common voltage $V_{com}$; therefore, on average, there is no voltage difference between data lines. In this conventional driving method, it is easy for the impurities P to pass through the data lines in an LCD. The present invention of driving method introduces different common voltages $V_{com1}$ and $V_{com2}$, which means some of the pixels are connected to $V_{com1}$ while the others are connected to $V_{com2}$ as shown in FIG. 14 and FIG. 15; as a result, on average, there are voltage differences between pixel areas in the LCD of the present invention. For example, the first common voltage $V_{com1}$ is connected to one end of the pixel area $P_{11}$ and the second common voltage $V_{com2}$ is connected to one end of another pixel area $P_{21}$. The first common voltage $V_{com1}$ is different from the second common voltage $V_{com2}$ and the pixel area $P_{11}$ is adjacent to the pixel area $P_{21}$. In this driving method, on average, a voltage difference rises between the first pixel area and the second pixel area. And the voltage difference is capable of trapping the impurity particles P. To analogize, if there is always a certain voltage difference between pixel areas by connecting to different common voltages, the movement of the impurities P is restricted, which lowers the degree the accumulation of the impurities P in a local region of the LCD.

Figure 16:
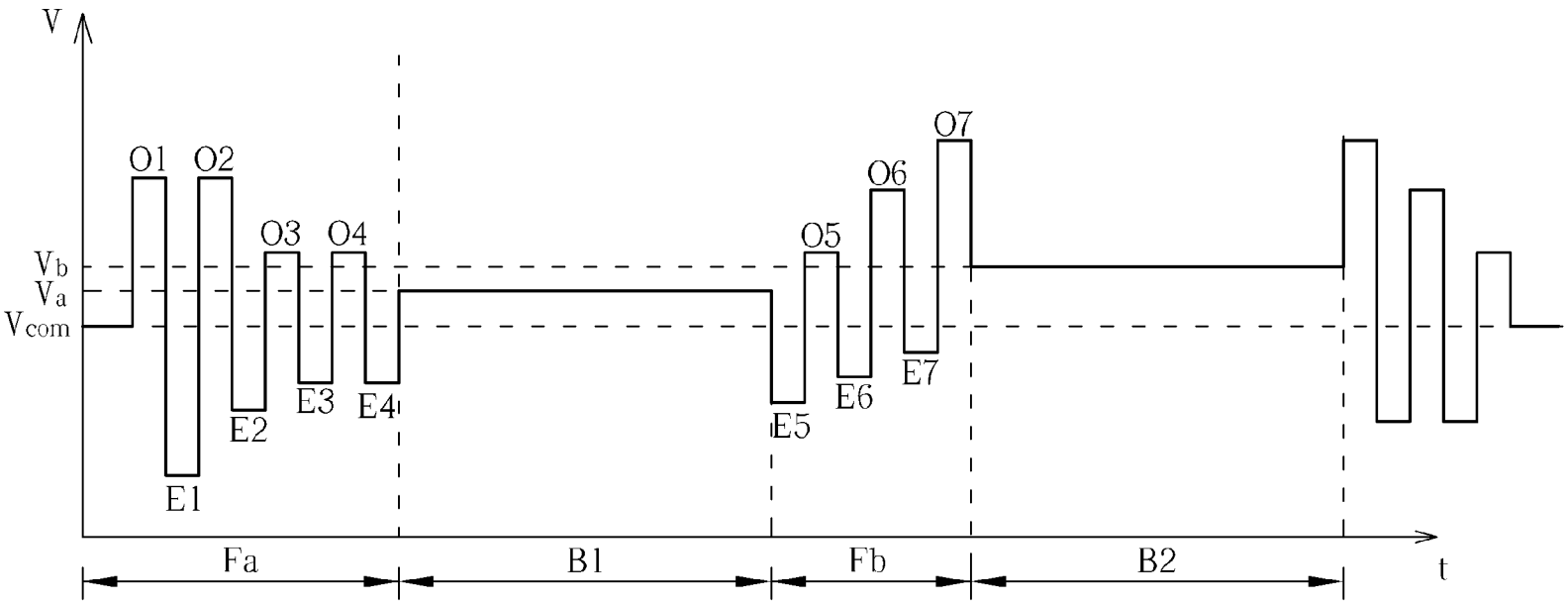
FIG. 16 is a diagram illustrating the driving method to improve image sticking for an LCD, which applies high voltages on the data lines during the blanking time according to another embodiment of the present invention.

Please refer to FIG. 16. FIG. 16 is a diagram illustrating another driving method to improve image sticking for an LCD, which applies voltages on the data lines during the blanking time according to another embodiment of the present invention. The difference between FIGS. 9 and 16 is that in FIG. 16 the voltages applied on the data lines during the blanking time can be adjusted dynamically according to data voltages corresponding to the displayed image in the frame period directly before the blanking time.

More specifically, the voltages applied on the data lines during the blanking time can be generated according to, or equivalent to, an average of data voltages corresponding to the displayed image in the frame period directly before the blanking time.

As illustrated in FIG. 16, voltages Va and Vb are applied on the data lines during a first blanking time B1 and a second blanking time B2 respectively. The voltage Va is generated according to an average of data voltages O1, O2, O3, O4, E1, E2, E3 and E4 that correspond to the displayed image in a first frame period Fa. The first frame period Fa is directly before to the first blanking time B1. The voltage Va may be applied to all data lines or a set of data lines during the first blanking time B1. If the voltage Va is applied just to a first set of data lines during the first blanking time B1, then a second set of data lines can be applied with another voltage with a polarity opposite to that of the voltage Va during the first blanking time B1. The voltage Vb is generated according to an average of data voltages O5, O6, O7, E5, E6 and E7 that correspond to the displayed image in a second frame period Fb. The second frame period Fb is directly before the second blanking time B2. The voltage Vb may be applied to all data lines or a set of data lines during the second blanking time B2. If the voltage Vb is applied just to a first set of data lines during the second blanking time B2, then a second set of data lines can be applied with another voltage with a polarity opposite to that of the voltage Vb during the second blanking time B2.

According to how the liquid crystal display device is driven, e.g. frame inversion, line inversion, dot inversion etc., the voltages can be applied on different sets of data lines during the blanking time. The voltages applied on different sets of data lines during the blanking time can be adjusted dynamically according to data voltages corresponding to the displayed image on the different sets of data lines respectively, in the frame period directly before the blanking time.

Figure 17:
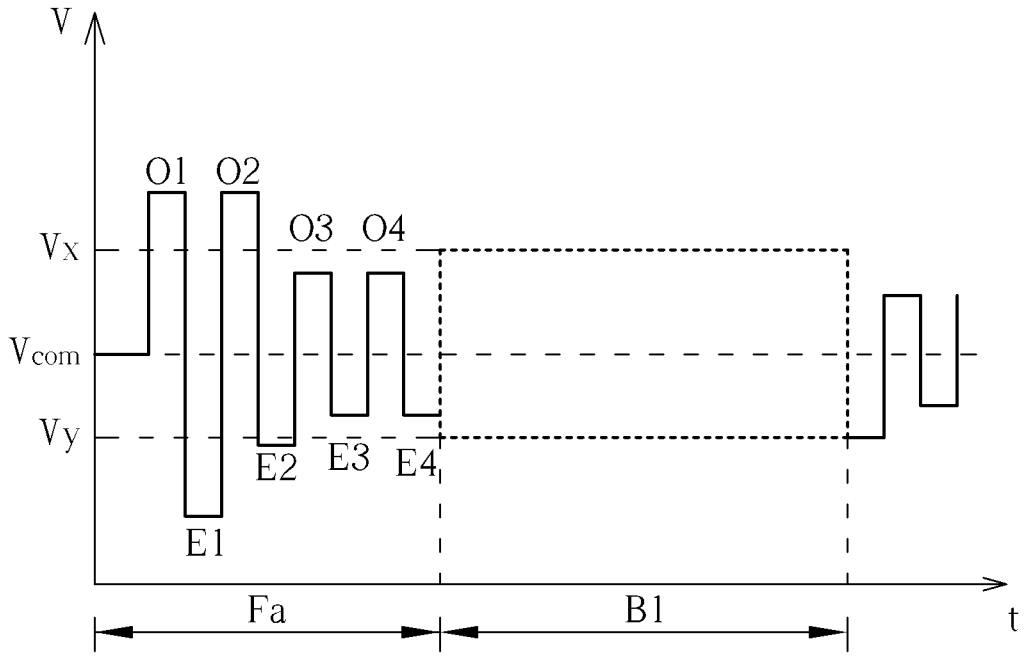
FIG. 17 is a diagram illustrating another driving method to improve image sticking for an LCD, which applies voltages on different sets of data lines during the blanking time according to another embodiment of the present invention.

Please refer to FIG. 17. FIG. 17 is a diagram illustrating another driving method to improve image sticking for an LCD, which applies voltages on different sets of data lines during the blanking time according to another embodiment of the present invention. Voltages Vx and Vy are applied on a first set of data lines and a second set of data lines respectively during a first blanking time B1. The voltage Vx is generated according to, or equivalent to an average of data voltages O1, O2, O3 and O4 that correspond to the displayed image on a first set of data lines in a first frame period Fa. The voltage Vy is generated according to, or equivalent to an average of data voltages E1, E2, E3 and E4 that correspond to the displayed image on a second set of data lines in the first frame period Fa. The first frame period Fa is directly before to the first blanking time B1. The first set of data lines may be, for instance, the odd numbered data lines of the plurality of data lines and the second set of data lines, and the second set of data lines may be the even numbered data lines of the plurality of data lines, and vice versa.

To sum up, the present invention utilizes: (1) applying voltages which are different from the common voltage during the blanking time, (2) converting data to voltage signals according to different data-to-voltage relations, and (3) connecting one end of the pixel areas to different common voltages, to effectively trap the impurities, restrict the movement of the impurities and lower the degree the accumulation of impurities; consequently, the image sticking effect is reduced and the display quality is ameliorated.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving method for reducing image sticking associated with images of a liquid crystal display, the liquid crystal display comprising a plurality of data lines, a plurality of scan lines and a plurality of pixel areas, the driving method comprising:

during a first period of time, sequentially turning on the plurality of scan lines and inputting data of a first image to the plurality of pixel areas;

during a second period of time, sequentially turning on the plurality of scan lines and inputting data of a second image to the plurality of pixel areas; and between the first period of time and the second period of time, generating and applying a first voltage according to voltage levels corresponding to the data of the first image, the first voltage preventing polarized impurities from crossing the plurality of data lines.

2. The driving method of claim 1, wherein applying the first voltage is applying the first voltage to a first set of the plurality of data lines.

3. The driving method of claim 1, wherein generating the first voltage according to the voltage levels corresponding to the data of the first image is generating the first voltage according to an average of the voltage levels corresponding to the data of the first image.

4. The driving method of claim 3, wherein the first voltage is equivalent to the average of the voltage levels corresponding to the data of the first image.

5. The driving method of claim 1, wherein applying the first voltage is applying the first voltage to all of the plurality of data lines.

6. The driving method of claim 1, further comprising:

between the first period of time and the second period of time, applying a second voltage to a second set of the plurality of data lines.

7. The driving method of claim 6, wherein a polarity of the second voltage is opposite to a polarity of the first voltage.

8. A driving method for reducing image sticking associated with images of a liquid crystal display, the liquid crystal display comprising a plurality of data lines, a plurality of scan lines and a plurality of pixel areas, the driving method comprising:

during a first period of time, sequentially turning on the plurality of scan lines and inputting data of a first image to the plurality of pixel areas;

during a second period of time, sequentially turning on the plurality of scan lines and inputting data of a second image to the plurality of pixel areas; and between the first period of time and the second period of time, generating and applying a first voltage according to voltage levels corresponding to data of the first image on a first set of the plurality of data lines, the first voltage preventing polarized impurities from crossing the first set of the plurality of data lines.

9. The driving method of claim 8, wherein applying the first voltage is applying the first voltage to the first set of the plurality of data lines.

10. The driving method of claim 8, wherein generating the first voltage according to the voltage levels corresponding to the data of the first image on the first set of the plurality of data lines is generating the first voltage according to an average of the voltage levels corresponding to the data of the first image on the first set of the plurality of data lines.

11. The driving method of claim 10, wherein the first voltage is equivalent to the average of the voltage levels corresponding to the data of the first image on the first set of the plurality of data lines.

12. The driving method of claim 8, further comprising:

between the first period of time and the second period of time, generating a second voltage according to voltage levels corresponding to data of the first image on a second set of the plurality of data lines, and applying the second voltage to the second set of the plurality of data lines.

13. The driving method of claim 12, wherein generating the second voltage according to the voltage levels corresponding to the data of the first image on the second set of the plurality of data lines is generating the second voltage according to an average of the voltage levels corresponding to the data of the first image on the second set of the plurality of data lines.

14. The driving method of claim 13, wherein the second voltage is equivalent to the average of the voltage levels corresponding to the data of the first image on the second set of the plurality of data lines.

* * * * *